US011203804B2

(12) United States Patent
Kagaya et al.

(10) Patent No.: US 11,203,804 B2
(45) Date of Patent: Dec. 21, 2021

(54) NICKEL-CONTAINING STEEL PLATE FOR USE AT LOW TEMPERATURE AND TANK FOR USE AT LOW TEMPERATURE USING THE SAME

(71) Applicant: NIPPON STEEL CORPORATION, Tokyo (JP)

(72) Inventors: Takayuki Kagaya, Tokyo (JP); Kazuyuki Kashima, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 94 days.

(21) Appl. No.: 16/499,169

(22) PCT Filed: Oct. 31, 2017

(86) PCT No.: PCT/JP2017/039451
§ 371 (c)(1),
(2) Date: Sep. 27, 2019

(87) PCT Pub. No.: WO2019/087318
PCT Pub. Date: May 9, 2019

(65) Prior Publication Data

US 2021/0108298 A1 Apr. 15, 2021

(51) Int. Cl.
*C22C 38/58* (2006.01)
*C22C 38/00* (2006.01)
(Continued)

(52) U.S. Cl.
CPC ..... *C22C 38/58* (2013.01); *C22C 38/001* (2013.01); *C22C 38/002* (2013.01);
(Continued)

(58) Field of Classification Search
CPC ..... C22C 38/58; C22C 38/001; C22C 38/002; C22C 38/005; C22C 38/02; C22C 38/00;
(Continued)

(56) References Cited

U.S. PATENT DOCUMENTS

2013/0098514 A1 4/2013 Furuya et al.
2014/0158258 A1* 6/2014 Furuya ..... C21D 8/0263 148/621

FOREIGN PATENT DOCUMENTS

EP 3392361 A1 * 10/2018 ..... C22C 38/02
JP 4-337025 A 11/1992
(Continued)

OTHER PUBLICATIONS

International Search Report for PCT/JP2017/039451 (PCT/ISA/210) dated Feb. 6, 2018.
(Continued)

*Primary Examiner* — Humera N. Sheikh
*Assistant Examiner* — Katherine A Christy
(74) *Attorney, Agent, or Firm* — Solaris Intellectual Property Group, PLLC

(57) ABSTRACT

A nickel-containing steel plate for use at a low temperature, having a predetermined chemical composition, in which the volume fraction of retained austenite at a position 1.5 mm from the surface of the steel plate in the thickness direction is from 3.0 to 20.0% by volume; in which the maximum distance between adjacent grains of retained austenite on prior austenite grain boundaries at the position 1.5 mm from the surface of the steel plate in the thickness direction is 12.5 μm or less; and in which the circle equivalent diameter of grains of retained austenite at a position corresponding to ¼ of the plate thickness from the surface of the steel plate in the thickness direction is 2.5 μm or less. A tank for use at a low temperature, which is produced using the above described nickel-containing steel plate for use at a low temperature.

16 Claims, 5 Drawing Sheets

(51) Int. Cl.

| | |
|---|---|
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/50*** | (2006.01) |
| ***C22C 38/54*** | (2006.01) |

(52) U.S. Cl.
CPC ..... *C22C 38/005* (2013.01); *C22C 38/02* (2013.01); *C22C 38/06* (2013.01); *C22C 38/42* (2013.01); *C22C 38/44* (2013.01); *C22C 38/46* (2013.01); *C22C 38/50* (2013.01); *C22C 38/54* (2013.01); *C21D 2211/001* (2013.01)

(58) Field of Classification Search
CPC ..... C22C 38/06; C22C 38/42; C22C 38/44; C22C 38/46; C22C 38/50; C22C 38/54
USPC ..... 420/106
See application file for complete search history.

(56) References Cited

FOREIGN PATENT DOCUMENTS

| | | | |
|---|---|---|---|
| JP | 4-371520 | A | 12/1992 |
| JP | 6-184630 | A | 7/1994 |
| JP | 9-137253 | A | 5/1997 |
| JP | 2011-214098 | A | 10/2011 |
| JP | 2011-214099 | A | 10/2011 |
| JP | 2011-241419 | A | 12/2011 |
| JP | 2014-34708 | A | 2/2014 |
| JP | 2017-89802 | A | 5/2017 |
| JP | 2017-115239 | A | 6/2017 |
| WO | WO 2012/005330 | A1 | 1/2012 |
| WO | WO 2013/046357 | A1 | 4/2013 |

OTHER PUBLICATIONS

Written Opinion of the International Searching Authority for PCT/JP2017/039451 (PCT/ISA/237) dated Feb. 6, 2018.

* cited by examiner

[FIG. 1]
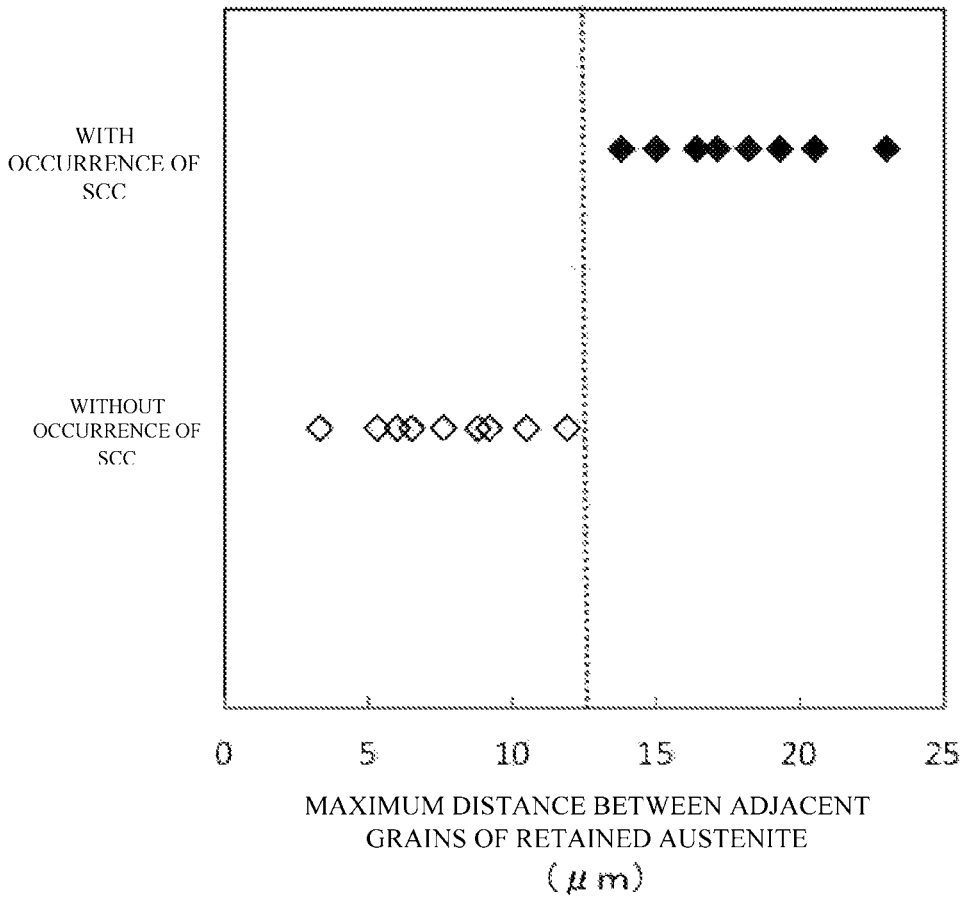

[FIG. 2]
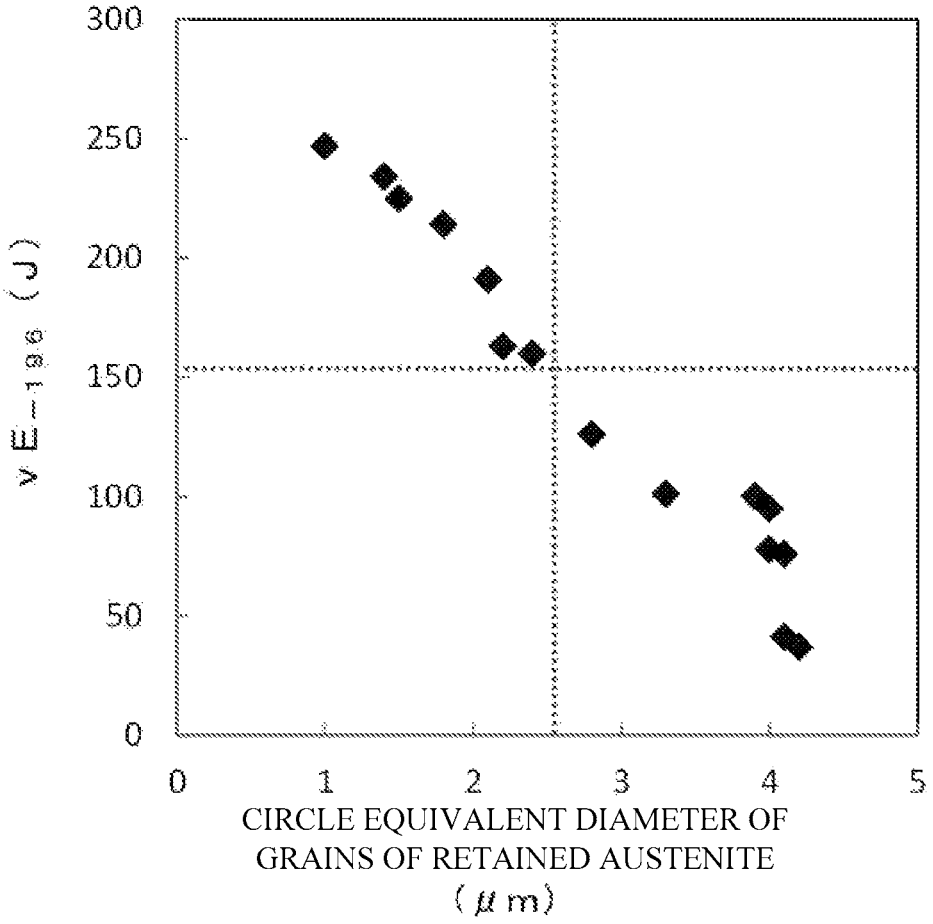

[FIG. 3]
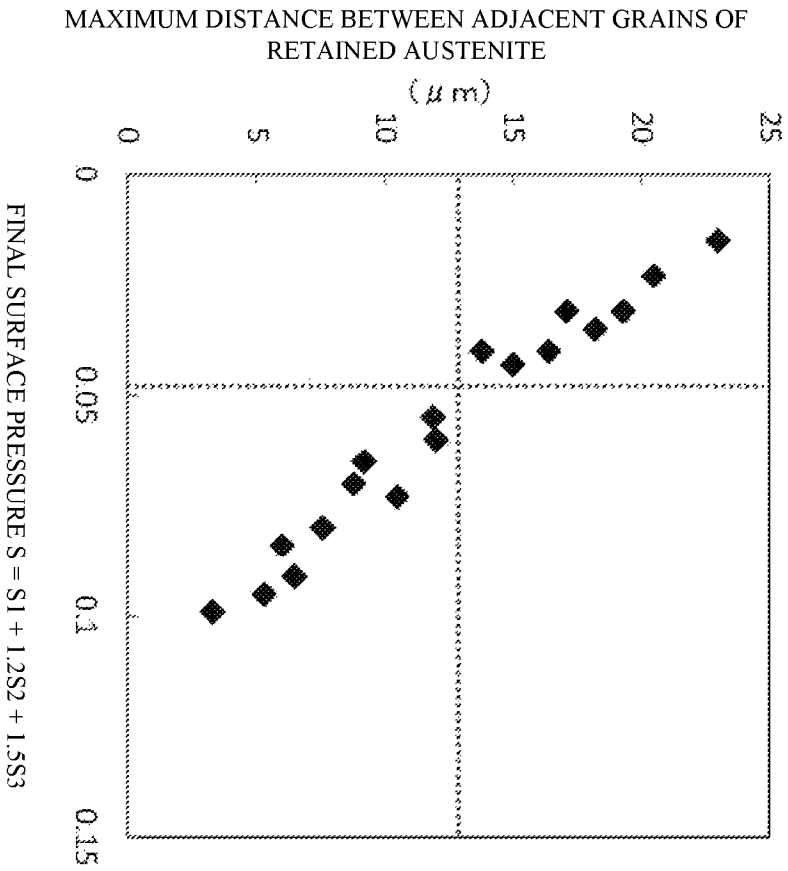

[FIG. 4]
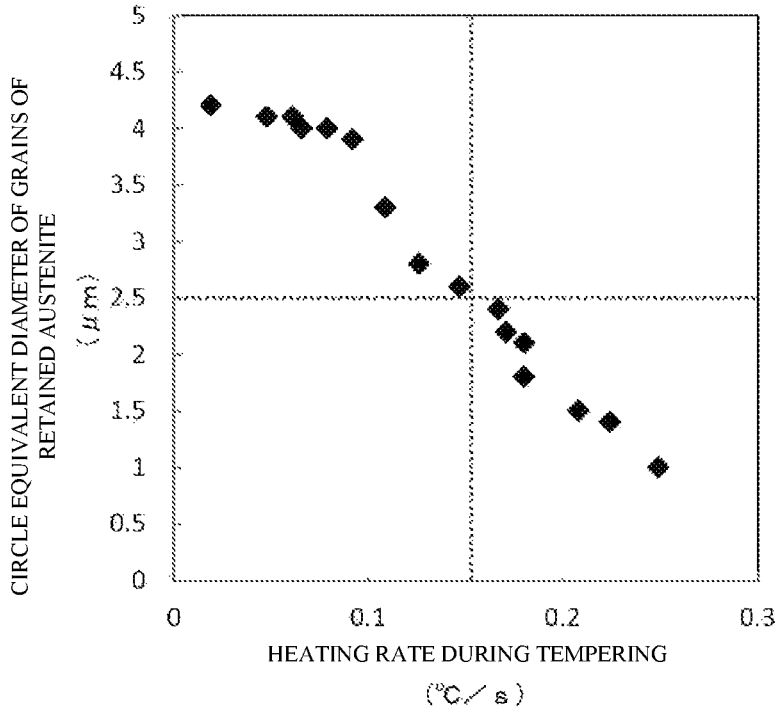

[FIG. 5]
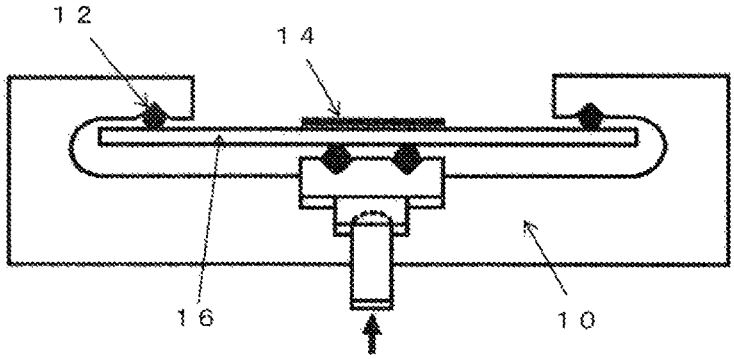
[FIG. 6]
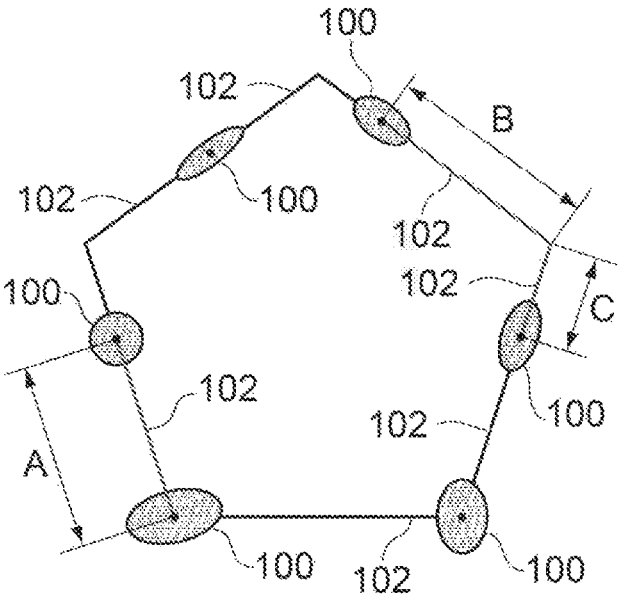

NICKEL-CONTAINING STEEL PLATE FOR USE AT LOW TEMPERATURE AND TANK FOR USE AT LOW TEMPERATURE USING THE SAME

TECHNICAL FIELD

The present disclosure relates to a nickel-containing steel plate for use at a low temperature, and a tank for use at a low temperature using the same.

BACKGROUND ART

The invention of the present disclosure is mainly used in a reservoir tank for storing a liquefied natural gas (boiling point: −164° C., hereinafter, referred to as "LNG"). A nickel-containing steel plate for use at a low temperature (hereinafter, referred to as a "Ni steel plate for use at a low temperature) used in a reservoir tank is required to have an excellent low temperature toughness. Examples of such a steel plate include plates made of a steel containing Ni within a range of from 5.00 to 9.50% (hereinafter, referred to as "5 to 9%-Ni steel).

Patent Documents 1 and 2 disclose steels having a Ni content of about 9% and a plate thickness of 40 mm or more, which are examples of prior art nickel-containing steel plates for use at a low temperature, that are used in reservoir tanks. Patent Document 1 discloses a technique in which an improvement in HAZ properties is achieved by reducing Si content and adding an adequate amount of Mo, at the same time. Patent Document 2 discloses a technique in which a stable precipitation of retained austenite and an improvement in low temperature toughness are achieved by reducing Si content and properly controlling cumulative rolling reduction.

Patent Document 3 proposes a steel plate containing Ni in an amount of from more than 11.0 to 13.0%, which can be used as a steel plate for which a high Ni content, a high strength and toughness, as well as a high stress corrosion cracking resistance to sea water or the like are required.

So far, 5 to 9%-Ni steels have been widely used in LNG tanks for use on land; however, these steels have almost never been employed for use in marine vessels, in the present circumstances.

Patent Document 1: Japanese Patent Application Laid-Open (JP-A) No. H04-371520

Patent Document 2: JP-A No. H06-184630

Patent Document 3: JP-A No. H09-137253

SUMMARY OF INVENTION

Technical Problem

One of the reasons for the fact that 5 to 9%-Ni steels have almost never been employed for use in marine vessels, is that there is a potential risk for stress corrosion cracking in a chloride environment. Regarding tanks for use in marine vessels (such as LNG tanks for use in marine vessels), a case has been reported in which cracks occurred in a tank made of a 5 to 9%-Ni steel, in a marine vessel which had been in service for about 25 years. In the present circumstances, aluminum alloys and stainless steels are mainly employed for use in marine vessels. In order to allow for the employment of Ni steels for use at a low temperature in marine vessels in the future, an important issue to be addressed is to devise countermeasures against stress corrosion cracking. A research report has already been released regarding the past case of occurrence of stress corrosion cracking in a tank made of a 5 to 9%-Ni steel. Specifically, the report describes that (1) dew condensation had occurred in the tank due to facility troubles, and (2) a weld heat affected zone (HAZ) where the cracks had occurred had a high hardness of about 420 Hv, and provides a view that hydrogen is thought to be responsible for the occurrence of stress corrosion cracking in the tank.

However, it is also described therein that, since no trace of S (sulfur) is observed in corrosion products, there is no ground for determining that hydrogen sulfide is involved in the cracking. As described above, many remain unclarified regarding causes for the stress corrosion cracking which had actually occurred.

The present disclosure provides: a nickel-containing steel plate for use at a low temperature, which steel plate is capable of exhibiting an excellent stress corrosion cracking resistance, without compromising base material strength and base material toughness; and a tank for use at a low temperature using the same.

Solution to Problem

Means for solving the above mentioned problem include the following embodiments.

<1> A nickel-containing steel plate for use at a low temperature, the steel plate comprising, in percentage by mass:

from 0.010 to 0.150% of C,
from 0.01 to 0.60% of Si,
from 0.20 to 2.00% of Mn,
0.010% or less of P,
0.010% or less of S,
from 5.00 to 9.50% of Ni,
from 0.005 to 0.100% of Al,
from 0.0010 to 0.0100% of N,
from 0 to 1.00% of Cu,
from 0 to 0.80% of Sn,
from 0 to 0.80% of Sb,
from 0 to 2.00% of Cr,
from 0 to 1.00% of Mo,
from 0 to 1.00% of W,
from 0 to 1.00% of V,
from 0 to 0.100% of Nb,
from 0 to 0.100% of Ti,
from 0 to 0.0200% of Ca,
from 0 to 0.0500% of B,
from 0 to 0.0100% of Mg,
from 0 to 0.0200% of REM, and
a balance being Fe and impurities, wherein a volume fraction of retained austenite at a position 1.5 mm from a surface of the steel plate in a thickness direction, is from 3.0 to 20.0% by volume, wherein a maximum distance between adjacent grains of retained austenite on prior austenite grain boundaries at the position 1.5 mm from the surface of the steel plate in the thickness direction, is 12.5 μm or less, and wherein a circle equivalent diameter of grains of retained austenite at a position corresponding to ¼ of a plate thickness from the surface of the steel plate in the thickness direction, is 2.5 μm or less.

<2> The nickel-containing steel plate for use at a low temperature according to <1>, wherein the content of Ni is from 8.00 to 9.50% by mass.

<3> The nickel-containing steel plate for use at a low temperature according to <1> or <2>, having a yielding strength of from 590 to 800 MPa, a tensile strength of from 690 to 830 MPa, and a Charpy impact absorption energy at −196° C. of 150 J or more.

<4> The nickel-containing steel plate for use at a low temperature according to any one of <1> to <3>, having a plate thickness of from 6 to 50 mm.

<5> A tank for use at a low temperature, wherein the tank comprising the nickel-containing steel plate for use at a low temperature according to any one of <1> to <4>.

Advantageous Effects of Invention

The present disclosure allows for providing a nickel-containing steel plate for use at a low temperature, which steel plate is capable of exhibiting an excellent stress corrosion cracking resistance, without compromising the base material strength and the base material toughness, and a tank for use at a low temperature using the same.

BRIEF DESCRIPTION OF DRAWINGS

FIG. 1 is a graph showing a relationship between the maximum distance between adjacent grains of retained austenite on prior austenite grain boundaries at a position 1.5 mm from the surface of the steel plate in the thickness direction, and a presence or absence of the occurrence of stress corrosion cracking (described in the figure as "SCC").

FIG. 2 is a graph showing a relationship between the circle equivalent diameter of grains of retained austenite at a position corresponding to ¼ of the plate thickness from the surface of the steel plate in the thickness direction, and the Charpy impact absorption energy at −196° C. (described in the figure as "$vE_{-196}$").

FIG. 3 is a graph showing a relationship between final surface pressure S and the maximum distance between adjacent grains of retained austenite on the prior austenite grain boundaries at the position 1.5 mm from the surface of the steel plate in the thickness direction.

FIG. 4 is a graph showing a relationship between a heating rate during tempering, and the circle equivalent diameter of the grains of retained austenite at the position corresponding to ¼ of the plate thickness from the surface of the steel plate in the thickness direction.

FIG. 5 is a diagram explaining a method of performing a chloride stress corrosion cracking test.

FIG. 6 is a schematic diagram showing examples of the maximum distance between adjacent grains of retained austenite on the prior austenite grain boundaries at the position 1.5 mm from the surface of the steel plate in the thickness direction.

DESCRIPTION OF EMBODIMENTS

A description will be given below regarding a nickel-containing steel plate for use at a low temperature (hereinafter, also referred to as a "Ni steel plate for use at a low temperature"), which is an example of the present disclosure.

It is to be noted, in the present disclosure, that the symbol: "%" used for describing the content of each element in a chemical composition refers to "% by mass".

Further, the "%" used for describing the content of each element refers to "% by mass", unless otherwise specified.

Any numerical range indicated using an expression "from * to" represents a range in which numerical values described before and after the "to" are included in the range as a lower limit value and an upper limit value.

The "thickness direction of the steel plate" is also referred to as a "plate thickness direction".

The Ni steel plate for use at a low temperature according to the present disclosure has a predetermined chemical composition to be described later. In the Ni steel plate for use at a low temperature surface, the volume fraction of retained austenite at a position 1.5 mm from the surface of the steel plate in the thickness direction is from 3.0 to 20.0% by volume; the maximum distance between adjacent grains of retained austenite on prior austenite grain boundaries at the position 1.5 mm from the surface of the steel plate in the thickness direction is 12.5 μm or less; and the circle equivalent diameter of grains of retained austenite at a position corresponding to ¼ of the plate thickness from the surface of the steel plate in the thickness direction is 2.5 μm or less.

The Ni steel plate for use at a low temperature, as used herein, may be a thick steel plate or a thin steel plate, and may be a forged product in the form of a plate or the like. The Ni steel plate for use at a low temperature mainly has a plate thickness of from 6 to 80 mm. However, the Ni steel plate may have a plate thickness of less than 6 mm (for example, a plate thickness of 4.5 mm or 3 mm), or a plate thickness of more than 80 mm (such as 100 mm).

By adopting the above described constitution, the resulting Ni steel plate for use at a low temperature according to the present disclosure is capable of exhibiting an excellent stress corrosion cracking resistance, without compromising the base material strength and the base material toughness. The Ni steel plate for use at a low temperature according to the present disclosure has been discovered based on the following findings.

First, the present inventors carried out an investigation, in order to secure the stress corrosion cracking resistance of the Ni steel plate for use at a low temperature, while securing the base material strength and the base material toughness thereof.

Specifically, the present inventors investigated for a Ni steel plate for use at a low temperature which can be used for producing a tank for use in a marine vessel (such as an LNG tank for use in a marine vessel), and the like.

First, the present inventors examined corrosive environments and acting stresses, taking into account a process from construction to operation of a tank for use in a marine vessel, and investigated the causes responsible for the occurrence of stress corrosion cracking. As a result, the present inventors obtained the following findings. The case of actual occurrence of stress corrosion cracking had occurred after the elapse of a long period of time, namely, about 25 years after the construction. Further, open inspections are carried out periodically (about once in five years) for tanks for use in marine vessels. In contrast, in tanks for use on land (such as LNG tanks) for which open inspections are not carried out, the stress corrosion cracking does not occur. In view of the above, it can be considered that the deposition of salt (namely, chlorides) in air, coming from the sea and entering into a tank during the open inspection, and the dew condensation inside the tank, are responsible for the occurrence of stress corrosion cracking.

Accordingly, the present inventors established a test method capable of reproducing the stress corrosion cracking caused by chlorides (hereinafter, also referred to as "chloride stress cracking"), by carrying out a test in which a stress simulating a residual stress at a welded portion is applied, and examined measures which can be taken for materials. As a result, the present inventors have obtained the following findings (a) to (c).

(a) When the volume fraction of retained austenite at a position 1.5 mm from the surface of the steel plate in the thickness direction is adjusted to from 3.0 to 20.0% by volume, the occurrence of chloride stress corrosion cracking is markedly prevented while securing the above described mechanical strength.

(b) When the maximum distance between adjacent grains of retained austenite on prior austenite grain boundaries at the position 1.5 mm from the surface of the steel plate in the thickness direction is adjusted to from 12.5 μm or less, the occurrence of chloride stress corrosion cracking is markedly prevented while securing the above described mechanical strength.

(c) When the circle equivalent diameter of grains of retained austenite at a position corresponding to ¼ of the plate thickness from the surface of the steel plate in the thickness direction is adjusted to 2.5 μm or less, the occurrence of chloride stress corrosion cracking is markedly prevented while securing the above described mechanical strength.

Based on the findings described above, it has been discovered that the Ni steel plate for use at a low temperature according to the present disclosure is capable of exhibiting an excellent stress corrosion cracking resistance (namely, chloride stress corrosion cracking resistance), without compromising the base material strength and the base material toughness.

Further, in a tank for use at a low temperature including the Ni steel plate for use at a low temperature according to the present disclosure, it is possible to prevent the occurrence of chloride stress corrosion cracking, even in a case in which the control of chlorides in air could not be performed during the open inspection of the tank for use at a low temperature, and/or a case in which dew condensation occurred inside the tank due to an inadequate humidity control in the tank. Accordingly, the tank for use at a low temperature is particularly suitable as a tank for use in a marine vessel (such as an LNG tank for use in a marine vessel). Thus, the Ni steel plate for use at a low temperature according to the present disclosure provides an extremely useful industrial contribution.

The tank for use at a low temperature is produced by welding a plurality of steel plates including at least the Ni steel plate for use at a low temperature according to the present disclosure. Examples of the tank for use at a low temperature include tanks of various type of shapes, such as cylinder tanks and spherical tanks.

The Ni steel plate for use at a low temperature according to the present disclosure will now be described in detail.

(A) Chemical Composition

A description will be given below regarding the reasons for limiting the chemical composition of the Ni steel plate for use at a low temperature according to the present disclosure (hereinafter, also referred to as the "chemical composition of the present disclosure").

The Amount of C: from 0.010 to 0.150%

C is an element which is necessary for securing the strength, and which serves to stabilize retained austenite. An amount of C of less than 0.010% may result in a reduced strength, a reduced amount of retained austenite, and a reduced chloride stress corrosion cracking resistance. Accordingly, the amount of C is set to 0.010% or more. The amount of C is preferably 0.030% or more, 0.040% or more, or 0.050% or more. However, an amount of C of more than 0.150% may lead to an excessive tensile strength, resulting in a marked decrease in the base material toughness. At the same time, an increase in surface layer hardness is more likely to occur, resulting in a decrease in chloride stress corrosion cracking resistance. Accordingly, the amount of C is set to be 0.150% or less. The amount of C is preferably 0.120% or less, 0.100% or less, or 0.080% or less.

The Amount of Si: from 0.01 to 0.60%

Si is an element which acts as a deoxidizing agent and which serves to secure the strength. Further, Si inhibits decomposition and precipitation reactions of cementite from martensite in a state of supersaturated solid solution, in a tempering step. By inhibiting the precipitation of cementite, carbon concentration in retained austenite is increased, to stabilize the retained austenite. As a result, the amount of retained austenite is increased, thereby improving the chloride stress corrosion cracking resistance. Accordingly, the amount of Si is set to 0.01% or more. The amount of Si is preferably 0.02% or more, and more preferably 0.03% or more. However, an amount of Si of more than 0.60% results in an excessive tensile strength and a decreased base material toughness. Accordingly, the amount of Si is set to 0.60% or less. The amount of Si is preferably 0.50% or less. The upper limit of the amount of Si may be set to 0.35%, 0.25%, 0.20%, or 0.15%, in order to improve the toughness.

The Amount of Mn: from 0.20 to 2.00%

Mn is an element which acts as a deoxidizing agent, and which is necessary for improving quenching hardenability and for securing the strength. Accordingly, the amount of Mn is set to 0.20% or more, in order to secure the yielding and the tensile strength of the base material. The amount of Mn is preferably 0.30% or more, and more preferably 0.50% or more, or 0.60% or more. However, an amount of Mn of more than 2.00% leads to unevenness in the properties of the base material in the plate thickness direction, due to center segregation, resulting in a decrease in the base material toughness. In addition, MnS, from which the corrosion in the steel plate starts, is formed to reduce corrosion resistance, thereby reducing the chloride stress corrosion cracking resistance. Accordingly, the amount of Mn is set to 2.00% or less. The amount of Mn is preferably 1.50% or less, 1.20% or less, 1.00% or less, or 0.90% or less.

The Amount of P: from 0.010% or Less

P is an impurity, and decreases the base material toughness by segregating at grain boundaries. Accordingly, the amount of P is limited to 0.010% or less. The amount of P is preferably 0.008% or less, or 0.005% or less. The smaller the amount of P, the more preferred it is. The lower limit of the amount of P is 0%. However, from the viewpoint of production cost, containing P in an amount of 0.0005% or more or 0.001% or more may be permitted.

The Amount of S: from 0.010% or Less

S is an impurity, and forms MnS, from which the corrosion in the steel plate starts, to reduce the corrosion resistance, thereby reducing the chloride stress corrosion cracking resistance. The presence of S may accelerate the center segregation, or may lead to the formation of MnS in the form of a stretched shape, from which brittle fracture starts, possibly causing a decrease in the base material toughness. Accordingly, the amount of S is limited to 0.010% or less. The amount of S is preferably 0.005% or less, or 0.004% or less. The smaller the amount of S, the more preferred it is. The lower limit of the amount of S is 0%. However, from the viewpoint of production cost, containing S in an amount of 0.0005% or more or 0.0001% or more may be permitted.

The Amount of Ni: from 5.00 to 9.50% (Preferably from 8.00 to 9.50%) or Less

Ni is an important element. A larger amount of Ni leads to a higher improvement in toughness at a low temperature. Accordingly, the amount of Ni is set to 5.00% or more, in order to secure the necessary toughness. The amount of Ni is preferably 5.50% or more, and more preferably 6.00% or more. In order to stably secure the base material toughness required for the Ni steel plate for use at a low temperature, in particular, the amount of Ni is preferably 8.00% or more, more preferably 8.20% or more, and still more preferably 8.50% or more. Although a larger amount of Ni leads to an improved low temperature toughness, it also leads to a higher cost as well as a markedly high corrosion resistance in a chloride environment. At the same time, localized corrosion marks (localized pits) are more likely to be formed because of the high corrosion resistance, and chloride stress corrosion cracking is more likely to occur due to stress concentration at the localized pits. Accordingly, the amount of Ni is set to 9.50% or less. The amount of Ni is preferably 9.40% or less.

The Amount of Al: from 0.005 to 0.100%

Al is an element which acts as a deoxidizing agent, and serves to prevent an increase in the amount of inclusions such as alumina and a decrease in the base material toughness, due to insufficient deoxidization. Further, Al also serves to inhibit the formation of cementite. When the formation of cementite is inhibited, the carbon concentration in retained austenite is increased, thereby stabilizes the retained austenite. As a result, the amount of retained austenite is increased, to improve the chloride stress corrosion cracking resistance. Accordingly, the amount of Al is set to 0.005% or more. The amount of Al is preferably 0.010% or more, 0.015% or more, or 0.020% or more. However, an amount of Al of more than 0.100% leads to a decrease in the base material toughness, due to causes attributable to inclusions. Accordingly, the amount of Al is set to 0.100% or less. The amount of Al is preferably 0.070% or less, 0.060% or less, or 0.050% or less.

The amount of N: from 0.0010 to 0.0100%

N is an element which serves to refine crystal grains by binding to Al to form AlN, thereby improving the base material toughness. Accordingly, the amount of N is set to 0.0010% or more. The amount of N is preferably 0.0015% or more. However, an amount of N of more than 0.0100% rather causes a decrease in the base material toughness. Accordingly, the amount of N is set to 0.0100% or less. The amount of N is preferably 0.0080% or less, 0.0060% or less, or 0.0050% or less.

The Ni steel plate for use at a low temperature according to the present disclosure includes, in addition to the above described components, Fe and impurities as the balance. The term "impurities" as used herein refers to components which are mixed during industrial production of the Ni steel plate for use at a low temperature due to a variety of factors involved in the production process, including raw materials such as ores and scraps, and which are permitted to the extent that the effect of the invention of the present disclosure is not adversely affected.

Further, the Ni steel plate for use at a low temperature according to the present disclosure may contain, if necessary, one kind or two or more kinds of: Cu, Sn, Sb, Cr, Mo, W, V, Nb, Ca, Ti, B, Mg and REM. In other words, these elements are not necessarily contained in the Ni steel plate for use at a low temperature according to the present disclosure, and the lower limit of the contents of these elements is 0%.

The Amount of Cu: from 0 to 1.00%

Cu has an effect of enhancing protections for corrosion products formed in a chloride environment, and, in the case of the occurrence of cracks, inhibiting dissolution of the steel plate at distal ends of the cracks, thereby preventing progression of the cracks. In order to stably obtain the effect of Cu, the amount of Cu is preferably 0.01% or more. The amount of Cu is more preferably 0.03% or more, and still more preferably 0.05% or more. However, an amount of Cu of more than 1.00% may lead to saturation of the effect, possibly resulting in a decrease in the base material toughness. Accordingly, the amount of Cu is set to 1.00% or less. The content of Cu is more preferably 0.80% or less, and still more preferably 0.60% or less, or 0.30% or less.

The Amount of Sn: from 0 to 0.80%

In a case in which cracks occurred in a corrosive environment, Sn dissolves as ions at the distal ends of the cracks, and provides an inhibitory effect to prevent a dissolution reaction, thereby markedly preventing the progression of the cracks. Since the above described effect can be obtained by incorporating Sn in an amount of more than 0%, the amount of Sn may be set to more than 0%. However, an amount of Sn of more than 0.80% may result in a marked decrease in the base material toughness. Accordingly, the amount of Sn is set to 0.80% or less. The amount of Sn is preferably 0.40% or less, more preferably 0.30% or less, 0.10% or less, 0.03% or less, or 0.003% or less.

The Amount of Sb: from 0 to 0.80%

In a case in which cracks occurred in a corrosive environment, Sb dissolves as ions at the distal ends of the cracks, as with the case of Sn, and provides an inhibitory effect to prevent a dissolution reaction, thereby markedly preventing the propagation of cracks. Since the above described effect can be obtained by incorporating Sb in an amount of more than 0%, the amount of Sb may be set to more than 0%. However, an amount of Sn of more than 0.80% may result in a marked decrease in the base material toughness. Accordingly, the amount of Sb is set to 0.80% or less. The amount of Sb is preferably 0.40% or less, more preferably 0.30% or less, 0.10% or less, 0.03% or less, or 0.003% or less.

The Amount of Cr: from 0 to 2.00%

Cr is an element which has an effect of enhancing the strength. Further, Cr also has an effect of reducing the corrosion resistance of the steel plate to prevent the formation of localized pits, in a thin water film environment in which chlorides are present, thereby preventing the occurrence of chloride stress corrosion cracking. In order to stably obtain the effects of Cr, the amount of Cr is preferably adjusted to 0.01% or more. An amount of Cr of more than 2.00%, however, may result not only in the saturation of the effect, but also in a decrease in the base material toughness. Accordingly, the amount of Cr is set to 2.00% or less. The amount of Cr is preferably 1.20% or less, 0.50% or less, 0.25% or less, or 0.10% or less.

The Amount of Mo: from 0 to 1.00%

Mo is an element which has an effect of enhancing the strength. Further, Mo which has dissolved in a corrosive environment forms molybdate ions. The chloride stress corrosion cracking in the Ni steel plate for use at a low temperature progresses as a result of the dissolution of the steel plate at the distal ends of the cracks. However, when molybdate ions are present, the inhibitory effect of the molybdate ions prevents the dissolution of the steel plate at the distal ends of the cracks, as a result of which crack resistance is significantly enhanced. In order to stably obtain the effects of Mo, the amount of Mo may be adjusted to 0.01% or more. The amount of Mo may be 0.20% or more. An amount of Mo of more than 1.00%, however, may result not only in the saturation of the effect of inhibiting the dissolution, but also in a marked decrease in the base material toughness. Accordingly, the amount of Mo is set to 1.00% or less. The amount of Mo is preferably 0.50% or less, 0.15% or less, or 0.08% or less.

The Amount of W: from 0 to 1.00%

W is an element which has the same effects as Mo. Further, W which has dissolved in a corrosive environment forms tungstate ions to inhibit the dissolution of the steel plate at the distal ends of the cracks, thereby improving the chloride stress corrosion cracking resistance. In order to stably obtain the effects of W, the amount of W may be adjusted to 0.01% or more. An amount of W of more than 1.00%, however, may result not only in the saturation of the effect, but also in a decrease in the base material toughness. Accordingly, the amount of W is set to 1.00% or less. The amount of W is preferably 0.50% or less, 0.10% or less, or 0.02% or less.

The Amount of V: from 0 to 1.00%

V is an element which also has the same effects as Mo. V which has dissolved in a corrosive environment forms vanadate ions to inhibit the dissolution of the steel plate at the distal ends of the cracks, thereby improving the chloride stress corrosion cracking resistance. In order to stably obtain the effects of V, the amount of V may be adjusted to 0.01% or more. An amount of V of more than 1.00%, however, may result not only in the saturation of the effect, but also in a decrease in the base material toughness. Accordingly, the amount of V is set to 1.00% or less. The amount of V is preferably 0.50% or less, 0.10% or less, or 0.02% or less.

The Amount of Nb: from 0 to 0.100%

Nb has not only an effect of refining the structure to improve the strength and the base material toughness, but also an effect of reinforcing an oxide film formed in the atmosphere to prevent the occurrence of chloride stress corrosion cracking. In order to stably obtain the effects of Nb, the amount of Nb may be adjusted to 0.001% or more. However, an excessive amount of Nb added may lead to the formation of coarse carbides or nitrides, possibly resulting in a decrease in the base material toughness. Accordingly, the amount of Nb is set to 0.100% or less. The amount of Nb is preferably 0.080% or less, 0.020% or less, or 0.005% or less.

The Amount of Ti: from 0 to 0.100%

Ti is an element which has an effect, when used for the purpose of deoxidization, of forming an oxide phase composed of Al, Ti and Mn, whereby refining the structure to improve the base material strength and the base material toughness. In addition, Ti also has an effect of markedly reducing the amount of MnS, from which the corrosion starts, by binding to S in the steel plate to form sulfides, thereby preventing the occurrence of chloride stress corrosion cracking. In order to stably obtain the effects of Ti, the amount of Ti may be adjusted to 0.001% or more.

However, an amount of Ti of more than 0.100% leads to the formation of Ti oxides or Ti—Al oxides, possibly resulting in a decrease in the base material toughness. Accordingly, the amount of Ti is set to 0.100% or less. The amount of Ti is preferably 0.080% or less, 0.020% or less, or 0.010% or less.

The Amount of Ca: from 0 to 0.0200%

Ca reacts with S in steel and forms acid sulfides (oxysulfides) in molten steel. Unlike MnS, the oxysulfides do not extend in a rolling direction by rolling processing, and remain in the form of spheres even after being subjected to rolling. The oxysulfides in the form of spheres inhibit, in the case of occurrence of cracks, the dissolution of the steel plate at the distal ends of the cracks, thereby improving the chloride stress corrosion cracking resistance. Therefore, in order to stably obtain the effect of Ca, the amount of Ca may be adjusted to 0.0003% or more. The amount of Ca is more preferably 0.0005% or more, and still more preferably 0.0010% or more.

However, a content of Ca of more than 0.0200% may lead to a decrease in toughness. Accordingly, the amount of Ca is set to 0.0200% or less. The amount of Ca is more preferably 0.0040% or less, and still more preferably 0.0030% or less, or 0.0020% or less.

The Amount of B: from 0 to 0.0500%

B is an element which has an effect of improving the base material strength. Therefore, in order to stably obtain the effect of B, the amount of B may be adjusted to 0.0003%. However, an amount of B of more than 0.0500% may lead to the precipitation of coarse boron compounds, to result in a decrease in the base material toughness. Accordingly, the amount of B is set to 0.0500% or less. The amount of B is preferably 0.0400% or less, and more preferably 0.0300% or less, 0.0020% or less.

The Amount of Mg: from 0 to 0.0100%

Mg is an element which has an effect of refining the grain size (circle equivalent diameter) of retained austenite, by forming fine Mg-containing oxides. Therefore, in order to stably obtain the effect of Mg, the amount of Mg may be adjusted to 0.0002% or more. However, an amount of Mg of more than 0.0100% may lead to too large an amount of oxides, possibly resulting in a decrease in the base material toughness. Accordingly, the amount of Mg is set to 0.0100% or less. The amount of Mg is more preferably 0.0050% or less, or 0.0010% or less.

The Amount of REM: from 0 to 0.0200%

REM controls the forms of inclusions, such as alumina and manganese sulfide, and thus is effective for improving the toughness. Therefore, in order to stably obtain the effect of REM, the amount of REM may be adjusted to 0.0002%.

However, too high a content of REM may lead to the formation of inclusions, possibly resulting in a decrease in cleanliness. Accordingly, the amount of REM is set to 0.0200% or less. The amount of REM is preferably 0.0020%, and more preferably 0.0010%.

It is to be noted that the "REM" is a generic term which collectively refers to a group of 17 elements, including 15 elements in the lanthanoid series, Y, and Sc. The amount of REM as used herein refers to the total content of these elements.

(B) Metallographic Structure

B-1. The volume fraction of retained austenite at a position 1.5 mm from the surface of the steel plate in the thickness direction (hereinafter also referred to as the "amount of retained austenite") is from 3.0 to 20.0% by volume.

Retained austenite in the steel plate prevents the propagation of cracks, and markedly improves the chloride stress corrosion cracking resistance. The retained austenite contains a large amount of Ni, and thus significantly inhibits the dissolution of the steel plate in a thin water film environment in which chlorides are present. Since chloride stress corrosion cracking is a phenomenon which occurs on the surface of the steel plate, the amount of retained austenite in a surface layer of the steel plate is important.

Although a larger amount of retained austenite leads to a higher improvement in the chloride stress corrosion cracking resistance, too large an amount leads to a decrease in the strength, resulting in a failure to secure the necessary strength.

Accordingly, the volume fraction of retained austenite at the position 1.5 mm from the surface of the steel plate in the thickness direction is set to 3.0 to 20.0% by volume.

From the viewpoint of improving the chloride stress corrosion cracking resistance, the amount of retained austenite is preferably 4.0% by volume or more, and more preferably 5.0% by volume or more. On the other hand, the amount of retained austenite is set to 20.0% by volume or less, from the viewpoint of preventing a decrease in the strength. The amount of retained austenite may be preferably 15% by volume or less, more preferably 12.0% by volume or less, 10.0% by volume or less, or 8.0% by volume or less.

The amount (volume fraction) of retained austenite is measured by the following method.

A test specimen is collected from the steel plate, such that a plane at a position 1.5 mm from the surface of the steel plate in the plate thickness direction constitutes an observation surface of the test specimen (the test specimen has dimensions of: 1.5 mm in the plate thickness direction, 25 mm in a width direction, and 25 mm in a longitudinal rolling direction; and the observation surface is a square of 25 mm×25 mm). The test specimen is subjected to an X-ray diffraction measurement, and the volume fraction of retained austenite phase is quantified from an integrated intensity of: planes (110), (200), and (211) of α-phase of BCC structure; and planes (111), (200), and (220) of γ-phase of FCC structure.

B-2. The maximum distance between adjacent grains of retained austenite on prior austenite grain boundaries at the position 1.5 mm from the surface of the steel plate in the thickness direction is 12.5 μm or less.

Cracks generated by chloride stress corrosion cracking progress preferentially along prior austenite grain boundaries. Since retained austenite acts as a resistance to the propagation of cracks, it is possible to enhance the chloride stress corrosion cracking resistance by reducing the distances between the grains of retained austenite which are densely present at the prior austenite grain boundaries, namely, the distances between respective adjacent grains of retained austenite at the boundaries.

Specifically, when the maximum distance between adjacent grains of retained austenite on the prior austenite grain boundaries is adjusted to 12.5 μm or less, the occurrence of chloride stress corrosion cracking is prevented. Further, since the chloride stress corrosion cracking is a phenomenon which occurs on the surface of the steel plate, the maximum distance between adjacent grains of retained austenite in the surface layer of the steel plate is important.

When the crystal grains are refined to increase the grain boundaries, propagation paths for cracks are increased to facilitate the propagation of cracks. Therefore, an average grain size of prior austenite (the mean value of the circle equivalent diameter of prior austenite grains as measured by EBSD (electron beam backscatter diffraction)) may be adjusted to more than 8 μm, 9 μm or more, or 10 μm or more. On the other hand, from the viewpoint of improving the low temperature toughness, the average grain size of prior austenite may be adjusted to 50 m or less, 40 μm or less, or 30 μm or less.

For the same reason, an effective grain size (the mean value of the circle equivalent diameter, as measured by EBSD (electron beam backscatter diffraction), of structural units surrounded by high angle grain boundaries with an orientation difference of 15° or more) may be adjusted to more than 5.5 μm, 6.0 μm or more, or 7.0 μm or more. In order to improve the low temperature toughness, on the other hand, the effective grain size may be adjusted to 40 μm or less, 30 m or less, or 20 μm or less.

FIG. 1 shows the relationship between the maximum distance between adjacent grains of retained austenite on the prior austenite grain boundaries at the position 1.5 mm from the surface of the steel plate in the thickness direction, and the presence or absence of the occurrence of stress corrosion cracking (described in the figure as "SCC"). As shown in FIG. 1, when the maximum distance between adjacent grains of retained austenite is 12.5 μm or less, the stress corrosion cracking does not occur.

Therefore, the maximum distance between adjacent grains of retained austenite on the prior austenite grain boundaries at the position 1.5 mm from the surface of the steel plate in the thickness direction is set to 12.5 μm or less.

From the viewpoint of improving the stress corrosion cracking resistance, the maximum distance between adjacent grains of retained austenite is preferably 10.0 μm or less, and more preferably 9.0 μm or less, 8.0 μm or less, or 7.0 μm or less.

It is to be noted that the lower limit of the maximum distance between adjacent grains of retained austenite is 0 μm, from the viewpoint of preventing the grains of retained austenite from binding to each other to be formed into coarse grains and thereby reducing the base material toughness; however, there are few cases in which the maximum distance is 0 μm. If necessary, the lower limit thereof may be set to 1.0 μm, 2.0 μm, 3.0 μm, or 4.0 μm.

The maximum distance between adjacent grains of retained austenite is measured by the following method.

On a "cross section vertical to the rolling direction and the thickness direction" of the steel plate, at a position 1.5 mm from the surface of the steel plate in the plate thickness direction, retained γ-phase at prior austenite grain boundaries was observed by EBSD (electron beam backscatter diffraction). Since a Kurdjumov-Sachs relationship is established between the orientation of prior austenite and the orientation of ferrite phase, ferrite crystal orientation was analyzed to obtain the crystal orientation of austenite phase before transformation, and prior austenite grain boundaries were identified therefrom. Thereafter, the distances between the centers of respective grains of retained austenite on the prior austenite grain boundaries (the distances on the paths passing through the grain boundaries of the prior austenite grains) were calculated. The observation was carried out in 20 or more visual fields, each having a size of 150 μm square.

The prior austenite grains were observed in 20 or more visual fields, the distances between the centers of respective adjacent grains of retained austenite were measured, and the maximum value thereof (namely, the maximum value of the measured distances between the respective adjacent grains of retained austenite) is taken as the maximum distance.

Examples of the maximum distance between adjacent grains of retained austenite are shown in FIG. 6. For example, as shown in FIG. 6, in a case in which the grain boundaries of prior austenite grains between adjacent grains of retained austenite are straight, Distance A is taken as the maximum distance between adjacent grains of retained austenite. In a case in which the grain boundaries of prior austenite grains between adjacent grains of retained austenite are bent, the total of Distance B and Distance C is taken as the maximum distance between adjacent grains of retained austenite.

In FIG. 6, Reference numerals 100 designate grains of retained austenite, and Reference numerals 102 designate the grain boundaries of prior austenite grains.

It is to be noted that the identification of the prior austenite grain boundaries is carried out, specifically, in accordance with the method described in literature (Kengo Hata, et al., "Development of a Reconstruction Method for Prior Austenite Microstructure Using EBSD Data of Ferrite Microstructure", Nippon Steel & Sumitomo Metal Corporation Technical Report, No. 404, pp 24-30, (2016)).

A-3. The circle equivalent diameter of grains of retained austenite at a position corresponding to ¼ of the plate thickness from the surface of the steel plate in the thickness direction is 2.5 μm or less.

Since retained austenite acts as a resistance to the propagation of cracks, as described above, it is desirable that retained austenite be densely present at the prior austenite grain boundaries. However, when retained austenite is present too densely, the grains of retained austenite are more likely to bind to each other to be formed into coarse grains. Coarse grains of retained austenite are unstable, and adversely affect the toughness of the resulting steel plate.

FIG. 2 shows the relationship between the circle equivalent diameter of the grains of retained austenite at the position corresponding to ¼ of the plate thickness from the surface of the steel plate in the thickness direction, and the Charpy impact absorption energy at −196° C. (described in the figure as "$vE_{-196}$"). As shown in FIG. 2, when the circle equivalent diameter of the grains of retained austenite is 2.5 μm or less, the resulting steel plate has an improved base material toughness, with a Charpy impact absorption energy (the mean value of three pieces of test specimens) of 150 J or more.

Accordingly, the circle equivalent diameter (average circle equivalent diameter) of the grains of retained austenite at the position corresponding to ¼ of the plate thickness from the surface of the steel plate in the thickness direction is set to 2.5 μm or less.

From the viewpoint of preventing a decrease in the base material toughness, the circle equivalent diameter of the grains of retained austenite is preferably 2.2 μm or less, and more preferably 2.0 μm or less, or 1.8 μm or less.

Although finer grains of retained austenite are preferred from the viewpoint of improving the toughness, the lower limit of the circle equivalent diameter may be set to 0.1 μm, based on the actual circle equivalent diameter of the grains of retained austenite. If necessary, the lower limit of the circle equivalent diameter of the grains of retained austenite may be 0.2 μm, 0.4 μm, or 0.5 μm.

The circle equivalent diameter of the grains of retained austenite is measured by the following method. The term "circle equivalent diameter" as used herein refers, when a subject to be measured (a grain of retained austenite) is considered as a circle, to the diameter of the circle, calculated from the area of the subject to be measured.

On a "cross section vertical to the rolling direction and the thickness direction" of the steel plate, at the position corresponding to ¼ of the plate thickness from the surface of the steel plate in the thickness direction, the grains of retained austenite are observed by EBSD, and the circle equivalent diameters of respective grains of retained austenite are measured. The observation is carried out in 20 or more visual fields, each having a size of 150 μm square. Thereafter, the mean value of the circle equivalent diameters of the respective grains of retained austenite, observed in 20 or more visual fields, is obtained.

It is preferred that the steel plate for use at a low temperature according to the present disclosure has a specific base material strength (namely, a yielding strength of from 590 to 800 MPa, and a tensile strength of from 690 to 830 MPa), and a specific base material toughness (namely, Charpy impact absorption energy at −196° C. (the mean value of the measured values of three pieces of test specimens) of 150 J or more), in order for the resulting tank for use at a low temperature to have a sufficient fracture resistance to pitching and rolling of marine vessels, or to huge earth quakes. The Ni steel plate for use at a low temperature according to the present disclosure having the chemical composition and the metallographic structure as described above, has an excellent toughness within a low temperature range of −60° C. or lower, particularly, under a low temperature environment of around −165° C., as well as an excellent chloride stress corrosion cracking resistance, and thus is suitable also for an application for storing a liquefied gas such as LPG or LNG under low temperature conditions.

The Ni steel plate for use at a low temperature according to the present disclosure preferably has a yielding strength of from 600 to 700 MPa.

The Ni steel plate for use at a low temperature according to the present disclosure preferably has a tensile strength of from 710 to 800 MPa.

The Ni steel plate for use at a low temperature according to the present disclosure preferably has a "Charpy impact absorption energy at −196° C." of 150 J or more, and more preferably 200 J or more. The Charpy impact absorption energy at −196° C. may be 400 J or less, although the upper limit thereof is not necessarily limited. It is to be noted, however, that the "Charpy impact absorption energy at −196° C." is the mean value of the measured values of the Charpy impact absorption energy of three pieces of test specimens.

The yielding strength (YS) and the tensile strength (TS) are measured as follows. Test specimens No. 4 (in the case of a plate thickness of more than 20 mm) or test specimens No. 5 (in the case of a plate thickness of 20 mm or less), as defined in JIS Z 2241 (2011), Appendix D, are collected from the steel plate at a position at which the distance from one end of the steel plate in the width direction corresponds to ¼ of a plate width. Using the thus collected test specimens, the yielding strength (YS) and the tensile strength (TS) are measured in accordance with JIS Z 2241 (2011). The yielding strength (YS) and the tensile strength (TS) are each measured for two pieces of test specimens at normal temperature (25° C.), and the mean values of the measured values are taken as the yielding strength (YS) and the tensile strength (TS), respectively.

The Charpy impact absorption energy at −196° C. is measured as follows. Three pieces of V-notch test specimens as defined in JIS Z 2224 (2005) are collected from the position of the steel plate at which the distance from one end of the steel plate in the width direction corresponds to ¼ of the plate width. Using the thus collected three pieces of test specimens, a Charpy impact test is carried out in accordance with JIS Z 2224 (2005), at a temperature condition of −196° C. The mean value of the measured values of the Charpy impact absorption energy of the three pieces of test specimens is taken as the test result.

Further, the Ni steel plate for use at a low temperature according to the present disclosure preferably has a plate thickness of from 4.5 to 80 mm, more preferably from 6 to 50 mm, and still more preferably from 12 to 30 mm.

A description will now be given below regarding one example of the method of producing the Ni steel plate for use at a low temperature according to the present disclosure. After casting a steel billet, the resulting billet is subjected to a homogenization heat treatment. Thereafter, the steel billet is heated again to be subjected to hot rolling, followed by a heat treatment at a predetermined temperature, to obtain the steel plate (see the following steps 1 to 5). The production method will be described below in detail. Casting conditions for obtaining the steel billet to be subjected to hot rolling are not particularly defined, as long as the steel billet contains the respective components within the range specified in the present disclosure, and a slab obtained by ingot casting and blooming, or a continuously cast slab may be used as a steel ingot. It is preferred to use a continuously cast slab, from the viewpoint of production efficiency, yield, and energy conservation.

Homogenization Heat Treatment (Step 1)

The steel billet is heated for homogenization before being subjected to blooming. The heating is preferably carried out at a temperature of from 1,200 to 1,350° C. for 10 hours or more. The heating may be omitted, in a case in which the steel billet contains little impurity elements, and it is possible to secure a sufficient base material toughness.

Pre-Hot Rolling Heat Treatment Step (Step 2)

The steel billet is heated to a temperature of from 1,000 to 1,250° C. This allows for reducing a load on rolling rolls while preventing the coarsening of the structure.

Hot Rolling Step (Step 3)

In the hot rolling step, the steel billet is subjected to rough rolling, and then to finish rolling. The rough rolling can be omitted. The steel billet is preferably hot rolled to a total rolling reduction of 50% or more.

The hot rolling is preferably completed at a finish rolling temperature of from 600 to 850° C. This allows for actively introducing deformation bands into the structure while reducing a deformation resistance, thereby enabling the refinement of the structure. The term "finish rolling temperature" as used herein refers to a surface temperature of the steel plate immediately after the completion of the finish rolling.

In particular, by introducing distortion in the last three passes of the finish rolling, a large amount of fine grains of retained austenite can be precipitated in the subsequent heat treatment step.

The surface pressure (reaction force during the rolling) in each of the last three passes of the finish rolling plays an important role. When the value of S (hereinafter, also referred to as "final surface pressure S"), calculated from the surface pressures of the respective last three passes of the finish rolling process, is 0.045 tonf/mm or more, it is possible to allow for the formation of retained austenite in a dense state.

FIG. 3 shows the relationship between the final surface pressure S and the maximum distance between adjacent grains of retained austenite on the prior austenite grain boundaries at the position 1.5 mm from the surface of the steel plate in the thickness direction. As shown in FIG. 3, when the final surface pressure S is 0.045 tonf/mm or more, the maximum distance between adjacent grains of retained austenite is 12.5 μm or less. As a result, the chloride stress corrosion cracking resistance can be improved.

Accordingly, the final surface pressure S is set to 0.045 tonf/mm or more. However, to achieve a final surface pressure S of more than 0.300, too high a load is placed on a rolling mill. Therefore, the final surface pressure S is preferably 0.300 or less.

The final surface pressure S can be calculated according to Formula: $S=S3+(1.2\times S2)+(1.5\times S1)$.

In the above Formula, S3 represents the surface pressure of the pass which is the third from the last pass, S2 represents the surface pressure of the pass which is the second from the last pass, and S1 represents the surface pressure of the last pass. The surface pressure of each pass is a value obtained by dividing the load during the rolling by the width of the steel plate (unit: tonf/mm).

Quenching Treatment Step (Step 4)

After the completion of the finish rolling, the resulting steel plate is cooled and subjected to a quenching treatment. In the quenching treatment step, it is preferred that the steel plate after the hot rolling is cooled to 200° C. or lower at a cooling rate of 3° C./s or more, or alternatively, the steel plate after the hot rolling be cooled to 150° C. or lower once, and then re-heated to 720° C. or more, followed by cooling to 200° C. or lower at a cooling rate of 3° C./sec or more. This allows for preventing the formation of coarse carbides while obtaining a quenched structure. In addition, a fine structure can be obtained, and the volume fraction of retained austenite at the position 1.5 mm from the surface of the steel plate in the thickness direction can be adjusted to from 3.0% to 20.0% by volume. As a result, the base material toughness is improved.

The cooling rate is preferably 5° C./sec or more. Further, the cooling is preferably carried out by injecting water to the surface and the back surface of the steel plate.

Tempering Treatment Step (Step 5)

After the completion of the quenching treatment, the steel plate is subjected to a tempering treatment. In the tempering treatment step, the steel plate is preferably heated to 640° C. or lower, and then cooled to 200° C. or lower at a cooling rate of 1° C./sec or more. This allows for improving the base material toughness.

In addition, by increasing the heating rate during tempering, a large amount of fine grains of retained austenite can be formed.

FIG. 4 shows the relationship between the heating rate during tempering, and the circle equivalent diameter of the grains of retained austenite at the position corresponding to ¼ of the plate thickness from the surface of the steel plate in the thickness direction. As shown in FIG. 4, when the heating rate during tempering is adjusted to 0.15° C./s or more, the circle equivalent diameter of the grains of retained austenite becomes 2.5 μm or less. As a result, the chloride stress corrosion cracking resistance can be improved.

Accordingly, the heating rate during tempering is set to 0.15° C./s or more. However, a heating rate during tempering of more than 2° C./s leads to an increase in the amount of retained austenite, resulting in a failure to secure the required tensile strength, which is equal to or higher than the lower limit of 690 MPa. Accordingly, the heating rate during tempering is preferably set to 2° C./s or less.

In the tempering step, an increase in the heating rate can be achieved, for example, by performing a heat treatment in which a preset temperature in a heating zone of a heat treatment furnace is increased, or by performing a heat treatment using an induction heating device. Although such methods can be used to increase the heating rate, a predetermined temperature should not be exceeded. Therefore, it is necessary not merely to use the above described methods, but also to strictly control the temperature of the steel plate during a heating process.

It is to be noted that an intermediate heat treatment step may be carried out between the above described step 4 and step 5. In the intermediate heat treatment step, the steel plate is heated, for example, to a temperature of from 550 to 720° C., and then cooled to 200° C. or lower at a cooling rate of 3° C./sec or more. This allows for improving the base material toughness. However, in a case in which the tempering can be performed sufficiently in the step 5, the steel plate has been softened to acquire a sufficient base material toughness, and thus, the intermediate heat treatment step can be omitted.

EXAMPLES

The present disclosure will now be described in further detail by way of Examples.

Forty-three types of steel plates having the respective chemical compositions shown in Table 1 were dissolved, to produce respective steel plates having a plate thickness of from 6 to 80 mm as shown in Table 2, under the respective production conditions shown therein. Specifically, a homogenization heat treatment (described in Table 2 as "Homogenization"), a pre-hot rolling heat treatment (described in Table 2 as "Pre-hot rolling heating"), hot rolling (described in Table 2 as "Hot rolling"), a quenching treatment (described in Table 2 as "Quenching"), an intermediate heat treatment (described in Table 2 as "Intermediate heating"), and a tempering treatment (described in Table 2 as "Tempering") were carried out, to obtain the respective steel plates.

In the case of carrying out the homogenization heat treatment, the treatment is carried out for a period of time from 10 to 49 hours.

The hot rolling was carried out to a total rolling reduction of from 65 to 95%. The thickness of each slab before being subjected to hot rolling is 240 mm, and the total rolling reduction is calculated from the slab thickness and the plate thickness of each steel plate shown in Table 2.

In Table 2, the description "-" indicates that the corresponding treatment is not carried out.

For each of the resulting steel plates, the measurements of the following items were carried out in accordance with the previously described methods: 1) the volume fraction of retained austenite at a position 1.5 mm from the surface of the steel plate in the thickness direction (described in Table 3 as "Volume fraction of retained γ"); 2) the maximum distance between adjacent grains of retained austenite on prior austenite grain boundaries at the position 1.5 mm from the surface of the steel plate in the thickness direction (described in Table 3 as "Maximum distance between retained γ"); and 3) the circle equivalent diameter of grains of retained austenite at a position corresponding to ¼ of the plate thickness from the surface of the steel plate in the thickness direction (described in Table 3 as "Circle equivalent diameter of retained γ").

The mechanical properties of the resulting steel plates are shown in Table 3. In the evaluation of the mechanical properties, a yielding strength (YS) of less than 590 MPa or more than 800 MPa, a tensile strength (TS) of less than 690 MPa or more than 830 MPa, and a Charpy impact absorption energy at −196° C. (vE−196), which is obtained as the mean value of the measured values of three steel plates, of less than 150 J, were each evaluated as "fail".

The mechanical properties of each of the steel plates were measured in accordance with the previously described methods.

A test specimen for stress corrosion cracking test, having a width of 10 mm, a length of 75 mm, and a thickness of 1.5 mm, was obtained from the outermost surface of each of the resulting steel plates. Each test specimen was polished using an abrasive paper up to No. 600. The test specimen was then set in a fixture for a four point bending test, in which four ceramic rods are used as shown in FIG. 5, and a stress of 590 MPa was applied to the test specimen.

It is to be noted that a test surface is the surface of the test specimen which used to be the surface of the steel plate. Subsequently, the test surface was coated with an aqueous solution of sodium chloride such that the amount of salt deposited per unit area is 5 $g/m^2$, and the specimen was allowed to corrode under the environment of a temperature of 60° C. and a relative humidity of 80% RH. The test was carried out for a test period of 1,000 hours. It is to be noted that the above described method is a method for carrying out a chloride stress corrosion cracking test simulating the environment in which salt is deposited inside the tank and a thin water film is formed on the surface of the steel plate. The aqueous solution was coated on the surface of the test specimen, and maintained in a high-temperature high-humidity furnace during the test period. From the test specimen after being subjected to the test, corrosion products were removed by physical and chemical means, and the presence or absence of cracks was evaluated by observing a cross section of a corroded portion, using a microscope.

An optical micrograph (270 μm×350 μm) of a nital etched cross section of each test specimen was taken at a magnification of 500-fold, in 20 visual fields, to carry out the observation. The results were evaluated taking into account irregularities caused by the corrosion. When the cracks had progressed to a position 50 μm or more from the surface of the test specimen in a depth direction, the test specimen was evaluated as "with cracks" and thus, as "fail" (described in the Table 3 as "NG"); whereas when the cracks had progressed to the position less than 50 μm from the surface in the depth direction, the test specimen was evaluated as "without cracks" and thus, as "pass" (described in the Table 3 as "OK").

In FIG. 5, Reference numeral 10 designates the test fixture, Reference numeral 12 designates the ceramic rod, Reference numeral 14 designates the deposited salt, and Reference numeral 16 designates the test specimen.

TABLE 1

| | | Chemical composition (% by mass, balance = Fe + impurities) | | | | | | | | | | | | | | | | | | | |
|---|---|---|---|---|---|---|---|---|---|---|---|---|---|---|---|---|---|---|---|---|---|
| | | C | Si | Mn | P | S | Ni | Al | N | Cu | Sn | Sb | Cr | Mo | W | V | Nb | Ti | Ca | B | Mg | REM |
| 1 | Example of Present Disclosure | 0.058 | 0.44 | 0.72 | 0.008 | 0.001 | 6.65 | 0.030 | 0.0016 | | | | | | | | | | | | | |
| 2 | Example of Present Disclosure | 0.080 | 0.36 | 0.57 | 0.001 | 0.003 | 6.94 | 0.017 | 0.0025 | | | | | | | | | | | | | |
| 3 | Example of Present Disclosure | 0.059 | 0.07 | 1.16 | 0.006 | 0.003 | 8.26 | 0.036 | 0.0024 | | | | 0.25 | 0.14 | | | | | | 0.0003 | | |
| 4 | Example of Present Disclosure | 0.054 | 0.02 | 0.84 | 0.004 | 0.004 | 7.00 | 0.047 | 0.0057 | | | | | | | | | | | | | |
| 5 | Example of Present Disclosure | 0.041 | 0.23 | 0.63 | 0.003 | 0.004 | 6.63 | 0.013 | 0.0030 | | | | 0.39 | | | | | | | | | |
| 6 | Example of Present Disclosure | 0.061 | 0.40 | 0.87 | 0.007 | 0.003 | 6.97 | 0.062 | 0.0021 | | 0.07 | | | 0.16 | | | | | | | | |
| 7 | Example of Present Disclosure | 0.078 | 0.23 | 0.88 | 0.006 | 0.002 | 7.98 | 0.054 | 0.0060 | | | | | | | | | | | | | |
| 8 | Example of Present Disclosure | 0.072 | 0.12 | 0.75 | 0.007 | 0.005 | 7.53 | 0.053 | 0.0048 | | | | | 0.15 | | | | | | | | |
| 9 | Example of Present Disclosure | 0.057 | 0.42 | 0.87 | 0.008 | 0.004 | 7.47 | 0.020 | 0.0015 | | | | | | 0.17 | | | | | | | |
| 10 | Example of Present Disclosure | 0.075 | 0.45 | 0.55 | 0.004 | 0.001 | 5.99 | 0.063 | 0.0016 | | 0.04 | | | | | | | | 0.0020 | | 0.0021 | 0.0060 |
| 11 | Example of Present Disclosure | 0.071 | 0.13 | 0.95 | 0.001 | 0.005 | 7.80 | 0.011 | 0.0045 | | | | | | 0.26 | | 0.039 | | | | | |
| 12 | Example of Present Disclosure | 0.047 | 0.30 | 0.50 | 0.004 | 0.005 | 7.96 | 0.027 | 0.0017 | | | | | | | | | 0.038 | | | | |
| 13 | Example of Present Disclosure | 0.012 | 0.25 | 0.93 | 0.006 | 0.001 | 6.89 | 0.066 | 0.0070 | 0.02 | | | | | | | | | | | | |
| 14 | Example of Present Disclosure | 0.069 | 0.02 | 0.58 | 0.005 | 0.002 | 5.75 | 0.060 | 0.0029 | | | | | 0.06 | | | | | | | | |
| 15 | Example of Present Disclosure | 0.042 | 0.24 | 0.25 | 0.008 | 0.003 | 7.66 | 0.012 | 0.0019 | | | | | | | | | | | | | |
| 16 | Example of Present Disclosure | 0.056 | 0.23 | 0.62 | 0.001 | 0.004 | 5.15 | 0.067 | 0.0071 | | | | | | | | 0.017 | | | | 0.0030 | |
| 17 | Example of Present Disclosure | 0.059 | 0.40 | 0.65 | 0.008 | 0.001 | 8.56 | 0.007 | 0.0075 | | | | | | | 0.17 | | | | | | |
| 18 | Example of Present Disclosure | 0.080 | 0.17 | 0.69 | 0.006 | 0.002 | 5.99 | 0.035 | 0.0012 | | | | | | | | | | | | | |
| 19 | Example of Present Disclosure | 0.150 | 0.15 | 0.90 | 0.005 | 0.005 | 8.51 | 0.040 | 0.0064 | 0.02 | | | | | | | | | | | | |
| 20 | Example of Present Disclosure | 0.040 | 0.60 | 0.56 | 0.003 | 0.005 | 8.78 | 0.049 | 0.0067 | | | 0.02 | | | | | | | | | | |
| 21 | Example of Present Disclosure | 0.051 | 0.31 | 2.00 | 0.004 | 0.001 | 7.55 | 0.057 | 0.0075 | | | | | 0.46 | | | 0.026 | | | | | |
| 22 | Example of Present Disclosure | 0.043 | 0.23 | 0.75 | 0.010 | 0.003 | 6.14 | 0.064 | 0.0035 | | | | | | | | | | | | | |
| 23 | Example of Present Disclosure | 0.075 | 0.24 | 1.03 | 0.007 | 0.010 | 8.40 | 0.037 | 0.0040 | | | | 0.19 | | 0.40 | | | 0.018 | | | 0.0037 | |
| 24 | Example of Present Disclosure | 0.073 | 0.24 | 0.70 | 0.001 | 0.005 | 9.50 | 0.054 | 0.0065 | | | | | | | | | | | | | |
| 25 | Example of Present Disclosure | 0.064 | 0.30 | 1.13 | 0.006 | 0.004 | 8.89 | 0.100 | 0.0071 | | | | | | | | | | | | | |
| 26 | Example of Present Disclosure | 0.046 | 0.38 | 0.69 | 0.005 | 0.005 | 6.65 | 0.044 | 0.0100 | | | | | | | | | | | | | |
| 27 | Comparative Example | 0.009 | 0.28 | 0.71 | 0.002 | 0.003 | 7.39 | 0.018 | 0.0080 | | | | | | | | | | | | | |
| 28 | Comparative Example | 0.071 | 0.005 | 0.73 | 0.007 | 0.001 | 6.99 | 0.011 | 0.0036 | | | | | | | | | 0.044 | | | | |
| 29 | Comparative Example | 0.055 | 0.36 | 0.19 | 0.007 | 0.003 | 8.63 | 0.034 | 0.0021 | | | | | | | | | | | | | |
| 30 | Comparative Example | 0.059 | 0.18 | 0.58 | 0.005 | 0.002 | 4.75 | 0.058 | 0.0015 | | | | 0.32 | | | | | | | | | |
| 31 | Comparative Example | 0.076 | 0.10 | 1.02 | 0.003 | 0.004 | 8.50 | 0.004 | 0.0078 | | | | | | | | | | | | | |
| 32 | Comparative Example | 0.076 | 0.42 | 0.98 | 0.007 | 0.001 | 7.11 | 0.035 | 0.0009 | | | | 0.21 | | | | | 0.046 | | | | |
| 33 | Comparative Example | 0.060 | 0.28 | 1.13 | 0.005 | 0.005 | 7.55 | 0.031 | 0.0071 | | | | | | | | | | | | | |
| 34 | Comparative Example | 0.051 | 0.40 | 0.90 | 0.001 | 0.005 | 8.68 | 0.060 | 0.0035 | | | | | | | | | | | | | |
| 35 | Comparative Example | 0.056 | 0.37 | 0.85 | 0.005 | 0.003 | 7.07 | 0.053 | 0.0059 | | | | | | | | | | | | | |
| 36 | Comparative Example | 0.165 | 0.43 | 1.03 | 0.007 | 0.003 | 6.78 | 0.015 | 0.0055 | | | | | 0.47 | | | | | | | | |
| 37 | Comparative Example | 0.048 | 0.66 | 1.05 | 0.003 | 0.003 | 5.56 | 0.013 | 0.0064 | | | | | | | 0.10 | | | | 0.0020 | | |
| 38 | Comparative Example | 0.073 | 0.25 | 2.25 | 0.007 | 0.004 | 7.97 | 0.048 | 0.0015 | 0.01 | | 0.03 | | 0.29 | | | 0.040 | | | | | |
| 39 | Comparative Example | 0.045 | 0.29 | 0.70 | 0.015 | 0.005 | 5.59 | 0.037 | 0.0016 | | | | | | 0.06 | | | | | | | 0.0065 |
| 40 | Comparative Example | 0.061 | 0.45 | 0.92 | 0.008 | 0.011 | 6.20 | 0.036 | 0.0018 | | | | | | | | | | | | | |
| 41 | Comparative Example | 0.078 | 0.35 | 0.68 | 0.002 | 0.005 | 10.55 | 0.021 | 0.0076 | | | 0.01 | | | | | | 0.017 | | | | |
| 42 | Comparative Example | 0.042 | 0.14 | 0.93 | 0.004 | 0.005 | 6.39 | 0.120 | 0.0066 | | | | | | | | | | | | | |
| 43 | Comparative Example | 0.072 | 0.31 | 0.94 | 0.001 | 0.005 | 6.07 | 0.045 | 0.0114 | | | | | | | | | | | | | |

TABLE 2

| | | Homogenization | | Pre-hot rolling heating | Hot rolling | | Quenching | | | Intermediate heating | | Tempering | | | |
|---|---|---|---|---|---|---|---|---|---|---|---|---|---|---|---|
| | | Heating Temperature (° C.) | Time (hr) | Heating Temperature (° C.) | Final surface pressure S in finish rolling (tonf/mm) | Finish rolling temperature (° C.) | Cooling rate after rolling (° C./sec) | Quenching temperature (° C.) | Cooling rate after quenching (° C./sec) | Heating Temperature (° C.) | Cooling rate after intermediate heating (° C./sec) | Heating rate (° C./sec) | Tempering temperature (° C.) | Cooling rate after tempering (° C./sec) | Plate thickness (mm) |
| 1 | Example of Present Disclosure | 1263 | 10 | 1034 | 0.122 | 794 | Once air cooled to 150° C. or lower | 869 | 8.2 | 648 | 8.8 | 0.26 | 578 | 8.9 | 25 |
| 2 | Example of Present Disclosure | 1211 | 15 | 1095 | 0.071 | 647 | 8.0 | — | — | 682 | 8.1 | 0.55 | 590 | 7.7 | 25 |
| 3 | Example of Present Disclosure | 1319 | 10 | 1173 | 0.112 | 730 | Once air cooled to 150° C. or lower | 877 | 4.7 | 664 | 4.5 | 0.30 | 611 | 4.7 | 6 |
| 4 | Example of Present Disclosure | 1225 | 23 | 1090 | 0.114 | 693 | Once air cooled to 150° C. or lower | 724 | 7.5 | 675 | 7.9 | 0.22 | 551 | 7.5 | 10 |
| 5 | Example of Present Disclosure | 1321 | 17 | 1031 | 0.123 | 769 | Once air cooled to 150° C. or lower | 764 | 9.2 | 691 | 9.4 | 0.59 | 579 | 9.9 | 30 |
| 6 | Example of Present Disclosure | 1341 | 12 | 1229 | 0.083 | 836 | Once air cooled to 150° C. or lower | 813 | 9.2 | 693 | 9.2 | 0.55 | 551 | 9.0 | 50 |
| 7 | Example of Present Disclosure | 1337 | 23 | 1100 | 0.072 | 660 | Once air cooled to 150° C. or lower | 780 | 9.9 | 680 | 10.1 | 0.54 | 555 | 9.9 | 80 |
| 8 | Example of Present Disclosure | 1337 | 29 | 1050 | 0.061 | 681 | 6.1 | — | — | 647 | 5.9 | 0.25 | 589 | 6.0 | 80 |
| 9 | Example of Present Disclosure | 1247 | 35 | 1154 | 0.136 | 712 | 8.7 | — | — | 710 | 10.0 | 0.59 | 608 | 9.5 | 25 |
| 10 | Example of Present Disclosure | 1318 | 49 | 1170 | 0.128 | 777 | 4.6 | — | — | 667 | 5.2 | 0.39 | 592 | 4.4 | 25 |
| 11 | Example of Present Disclosure | — | — | 1074 | 0.126 | 665 | Once air cooled to 150° C. or lower | 833 | 10.0 | 696 | 10.5 | 0.36 | 617 | 9.5 | 25 |
| 12 | Example of Present Disclosure | 1253 | 15 | 1060 | 0.111 | 782 | Once air cooled to 150° C. or lower | 728 | 3.6 | — | — | 0.42 | 569 | 3.4 | 25 |
| 13 | Example of Present Disclosure | 1243 | 34 | 1213 | 0.053 | 644 | Once air cooled to 150° C. or lower | 790 | 9.9 | 696 | 9.6 | 0.45 | 565 | 10.0 | 25 |
| 14 | Example of Present Disclosure | 1291 | 14 | 1070 | 0.144 | 776 | 6.6 | — | — | 659 | 8.2 | 0.59 | 584 | 7.2 | 25 |
| 15 | Example of Present Disclosure | 1330 | 12 | 1157 | 0.144 | 726 | 4.9 | — | — | — | — | 0.21 | 565 | 5.1 | 25 |
| 16 | Example of Present Disclosure | 1302 | 10 | 1070 | 0.083 | 704 | 6.9 | — | — | — | — | 0.37 | 590 | 6.9 | 25 |
| 17 | Example of Present Disclosure | 1282 | 22 | 1169 | 0.136 | 815 | 9.5 | — | — | 653 | 9.9 | 0.51 | 561 | 9.6 | 25 |
| 18 | Example of Present Disclosure | 1326 | 17 | 1200 | 0.134 | 705 | 6.4 | — | — | 667 | 5.9 | 0.52 | 568 | 7.0 | 25 |
| 19 | Example of Present Disclosure | 1310 | 26 | 1064 | 0.091 | 694 | Once air cooled to 150° C. or lower | 770 | 9.2 | — | — | 0.52 | 584 | 10.1 | 25 |

TABLE 2-continued

| | | Homogenization | | Pre-hot rolling heating | Hot rolling | | Quenching | | | Intermediate heating | | Tempering | | | |
|---|---|---|---|---|---|---|---|---|---|---|---|---|---|---|---|
| | | Heating Temperature (° C.) | Time (hr) | Heating Temperature (° C.) | Final surface pressure S in finish rolling (tonf/mm) | Finish rolling temperature (° C.) | Cooling rate after rolling (° C./sec) | Quenching temperature (° C.) | Cooling rate after quenching (° C./sec) | Heating Temperature (° C.) | Cooling rate after intermediate heating (° C./sec) | Heating rate (° C./sec) | Tempering temperature (° C.) | Cooling rate after tempering (° C./sec) | Plate thickness (mm) |
| 20 | Example of Present Disclosure | 1220 | 29 | 1041 | 0.075 | 836 | 4.2 | — | — | 696 | 3.5 | 0.39 | 560 | 4.0 | 25 |
| 21 | Example of Present Disclosure | 1200 | 44 | 1075 | 0.101 | 792 | 4.8 | — | — | 665 | 5.5 | 0.44 | 600 | 5.0 | 25 |
| 22 | Example of Present Disclosure | 1321 | 31 | 1056 | 0.110 | 795 | Once air cooled to 150° C. or lower | 805 | 9.7 | 687 | 8.8 | 0.41 | 591 | 9.1 | 25 |
| 23 | Example of Present Disclosure | 1263 | 14 | 1218 | 0.135 | 684 | 5.9 | — | — | 646 | 6.3 | 0.59 | 586 | 6.1 | 25 |
| 24 | Example of Present Disclosure | 1286 | 12 | 1085 | 0.095 | 634 | Once air cooled to 150° C. or lower | 817 | 5.9 | — | — | 0.29 | 596 | 5.6 | 25 |
| 25 | Example of Present Disclosure | 1325 | 12 | 1113 | 0.063 | 802 | Once air cooled to 150° C. or lower | 907 | 8.3 | — | — | 0.36 | 602 | 8.5 | 25 |
| 26 | Example of Present Disclosure | 1334 | 10 | 1210 | 0.108 | 763 | 3.5 | — | — | 685 | 3.9 | 0.16 | 608 | 3.7 | 25 |
| 27 | Comparative Example | 1272 | 14 | 1169 | 0.145 | 769 | Once air cooled to 150° C. or lower | 828 | 6.7 | 660 | 6.4 | 0.26 | 619 | 6.5 | 25 |
| 28 | Comparative Example | 1319 | 25 | 1023 | 0.072 | 668 | 3.6 | — | — | 667 | 3.7 | 0.37 | 554 | 3.9 | 25 |
| 29 | Comparative Example | 1311 | 25 | 1175 | 0.076 | 802 | 8.5 | — | — | 656 | 6.9 | 0.34 | 582 | 8.2 | 25 |
| 30 | Comparative Example | 1236 | 29 | 1184 | 0.134 | 700 | 10.3 | — | — | 704 | 9.6 | 0.31 | 571 | 9.6 | 25 |
| 31 | Comparative Example | 1305 | 28 | 1070 | 0.097 | 671 | Once air cooled to 150° C. or lower | 838 | 3.6 | — | — | 0.60 | 564 | 3.7 | 25 |
| 32 | Comparative Example | 1246 | 17 | 1030 | 0.144 | 820 | Once air cooled to 150° C. or lower | 847 | 3.5 | 687 | 3.2 | 0.28 | 613 | 3.7 | 25 |
| 33 | Comparative Example | 1286 | 19 | 1115 | 0.021 | 828 | Once air cooled to 150° C. or lower | 739 | 9.2 | 719 | 8.5 | 0.52 | 602 | 9.1 | 25 |
| 34 | Comparative Example | 1250 | 20 | 1101 | 0.105 | 712 | 2.2 | — | — | 699 | 6.8 | 0.32 | 600 | 7.6 | 25 |
| 35 | Comparative Example | 1315 | 18 | 1169 | 0.072 | 808 | 9.8 | — | — | — | — | 0.08 | 566 | 10.6 | 25 |
| 36 | Comparative Example | 1210 | 29 | 1205 | 0.103 | 649 | Once air cooled to 150° C. or lower | 733 | 4.7 | — | — | 0.44 | 569 | 4.9 | 25 |
| 37 | Comparative Example | 1289 | 11 | 1156 | 0.089 | 633 | Once air cooled to 150° C. or lower | — | — | 701 | 8.7 | 0.27 | 559 | 8.4 | 25 |
| 38 | Comparative Example | 1246 | 21 | 1214 | 0.110 | 684 | 6.6 | — | — | 661 | 7.2 | 0.18 | 595 | 7.1 | 25 |
| 39 | Comparative Example | 1284 | 12 | 1098 | 0.113 | 805 | 8.3 | — | — | — | — | 0.56 | 556 | 8.0 | 25 |

TABLE 2-continued

| | | Homogenization | | Pre-hot rolling heating | Hot rolling | | Quenching | | | Intermediate heating | | Tempering | | | |
|---|---|---|---|---|---|---|---|---|---|---|---|---|---|---|---|
| | | Heating Temperature (° C.) | Time (hr) | Heating Temperature (° C.) | Final surface pressure S in finish rolling (tonf/mm) | Finish rolling temperature (° C.) | Cooling rate after rolling (° C./sec) | Quenching temperature (° C.) | Cooling rate after quenching (° C./sec) | Heating Temperature (° C.) | Cooling rate after intermediate heating (° C./sec) | Heating rate (° C./sec) | Tempering temperature (° C.) | Cooling rate after tempering (° C./sec) | Plate thickness (mm) |
| 40 | Comparative Example | 1315 | 39 | 1169 | 0.072 | 808 | 9.8 | — | — | — | — | 0.30 | 566 | 10.6 | 25 |
| 41 | Comparative Example | 1246 | 10 | 1067 | 0.101 | 708 | Once air cooled to 150° C. or lower | 737 | 5.5 | — | — | 0.19 | 585 | 5.8 | 25 |
| 42 | Comparative Example | 1336 | 16 | 1098 | 0.143 | 837 | 5.3 | — | — | — | — | 0.21 | 582 | 5.3 | 25 |
| 43 | Comparative Example | 1201 | 19 | 1092 | 0.118 | 776 | 11.0 | — | — | 697 | 10.4 | 0.42 | 560 | 10.7 | 25 |

TABLE 3

| | | Volume fraction of retained γ (vol. %) | Maximum distance between retained γ (μm) | Circle equivalent diameter of retained γ (μm) | YS (MPa) | TS (MPa) | vE-196 (J) | Result of chloride stress corrosion cracking test |
|---|---|---|---|---|---|---|---|---|
| 1 | Example of Present Disclosure | 6.2 | 4.0 | 2.4 | 635 | 737 | 234 | OK |
| 2 | Example of Present Disclosure | 5.3 | 2.1 | 0.6 | 649 | 764 | 242 | OK |
| 3 | Example of Present Disclosure | 6.0 | 12.1 | 0.8 | 639 | 736 | 232 | OK |
| 4 | Example of Present Disclosure | 5.9 | 3.5 | 1.6 | 635 | 739 | 235 | OK |
| 5 | Example of Present Disclosure | 6.4 | 3.1 | 0.7 | 627 | 747 | 236 | OK |
| 6 | Example of Present Disclosure | 6.2 | 9.1 | 0.6 | 637 | 735 | 242 | OK |
| 7 | Example of Present Disclosure | 5.4 | 11.3 | 1.1 | 649 | 725 | 238 | OK |
| 8 | Example of Present Disclosure | 5.3 | 11.3 | 0.7 | 646 | 702 | 240 | OK |
| 9 | Example of Present Disclosure | 6.3 | 6.4 | 1.6 | 636 | 737 | 239 | OK |
| 10 | Example of Present Disclosure | 5.6 | 9.3 | 2.1 | 643 | 727 | 239 | OK |
| 11 | Example of Present Disclosure | 5.5 | 12.1 | 2.1 | 645 | 729 | 233 | OK |
| 12 | Example of Present Disclosure | 6.1 | 2.6 | 1.5 | 635 | 742 | 234 | OK |
| 13 | Example of Present Disclosure | 7.7 | 3.3 | 1.7 | 610 | 692 | 231 | OK |
| 14 | Example of Present Disclosure | 5.2 | 6.3 | 1.0 | 640 | 731 | 239 | OK |
| 15 | Example of Present Disclosure | 6.0 | 6.0 | 0.6 | 633 | 745 | 249 | OK |
| 16 | Example of Present Disclosure | 6.0 | 6.4 | 0.9 | 630 | 739 | 232 | OK |
| 17 | Example of Present Disclosure | 16.7 | 4.9 | 0.8 | 642 | 735 | 233 | OK |
| 18 | Example of Present Disclosure | 5.2 | 12.4 | 2.4 | 646 | 724 | 237 | OK |
| 19 | Example of Present Disclosure | 3.0 | 10.7 | 1.4 | 689 | 771 | 230 | OK |
| 20 | Example of Present Disclosure | 6.8 | 4.0 | 2.0 | 632 | 746 | 229 | OK |
| 21 | Example of Present Disclosure | 7.3 | 2.0 | 1.5 | 627 | 742 | 218 | OK |
| 22 | Example of Present Disclosure | 6.5 | 8.1 | 2.5 | 626 | 746 | 235 | OK |
| 23 | Example of Present Disclosure | 5.6 | 6.5 | 2.5 | 648 | 726 | 233 | OK |
| 24 | Example of Present Disclosure | 5.3 | 4.8 | 1.2 | 653 | 726 | 246 | OK |
| 25 | Example of Present Disclosure | 6.1 | 3.4 | 1.5 | 643 | 733 | 234 | OK |
| 26 | Example of Present Disclosure | 6.5 | 10.2 | 1.7 | 629 | 744 | 233 | OK |
| 27 | Comparative Example | 2.1 | 21.6 | 2.1 | 568 | 668 | 285 | NG |
| 28 | Comparative Example | 5.2 | 3.0 | 0.5 | 644 | 684 | 235 | OK |
| 29 | Comparative Example | 6.3 | 6.5 | 2.0 | 587 | 637 | 245 | OK |
| 30 | Comparative Example | 1.1 | 30.5 | 1.6 | 631 | 738 | 74 | NG |
| 31 | Comparative Example | 5.3 | 21.1 | 6.8 | 650 | 726 | 144 | NG |
| 32 | Comparative Example | 3.5 | 6.8 | 1.1 | 644 | 726 | 108 | OK |
| 33 | Comparative Example | 5.7 | 19.6 | 1.2 | 640 | 733 | 233 | NG |
| 34 | Comparative Example | 2.8 | 6.5 | 2.2 | 641 | 740 | 125 | NG |
| 35 | Comparative Example | 4.3 | 6.8 | 3.6 | 655 | 741 | 233 | NG |
| 36 | Comparative Example | 3.1 | 10.2 | 0.8 | 814 | 860 | 45 | NG |
| 37 | Comparative Example | 7.2 | 5.0 | 1.9 | 624 | 834 | 114 | OK |
| 38 | Comparative Example | 6.7 | 11.3 | 2.3 | 639 | 712 | 98 | NG |
| 39 | Comparative Example | 6.5 | 4.6 | 1.9 | 625 | 745 | 112 | OK |
| 40 | Comparative Example | 6.4 | 11.4 | 1.8 | 634 | 736 | 121 | NG |
| 41 | Comparative Example | 21.5 | 5.7 | 1.5 | 577 | 701 | 298 | NG |
| 42 | Comparative Example | 6.5 | 6.1 | 2.1 | 625 | 747 | 141 | OK |
| 43 | Comparative Example | 5.8 | 8.4 | 0.5 | 640 | 729 | 133 | OK |

It can be seen from Tables 1 to 3 that each of the Ni steel plates for use at a low temperature according to the Examples of the present disclosure has an excellent base material strength, base material toughness, and stress corrosion cracking resistance, and thus is excellent as a low temperature material.

In contrast, it can be seen that each of the Ni steel plates of Comparative Examples not satisfying the conditions defined in the present disclosure, fails to obtain intended properties, namely, does not have a desired base material strength, base material toughness, and stress corrosion cracking resistance.

What is claimed is:

1. A nickel-containing steel plate comprising, in percentage by mass:

from 0.010 to 0.150% of C,
from 0.01 to 0.60% of Si,
from 0.20 to 2.00% of Mn,
0.010% or less of P,
0.010% or less of S,
from 5.00 to 9.50% of Ni,
from 0.005 to 0.100% of Al,
from 0.0010 to 0.0100% of N,
from 0 to 1.00% of Cu,
from 0 to 0.80% of Sn,
from 0 to 0.80% of Sb,
from 0 to 2.00% of Cr,
from 0 to 1.00% of Mo,
from 0 to 1.00% of W,
from 0 to 1.00% of V,
from 0 to 0.100% of Nb,
from 0 to 0.100% of Ti,
from 0 to 0.0200% of Ca,
from 0 to 0.0500% of B,
from 0 to 0.0100% of Mg,
from 0 to 0.0200% of REM, and
a balance being Fe and impurities, wherein a volume fraction of retained austenite quantified from an integrated intensity of: planes (110), (200), and (211) of α-phase of BCC structure; and planes (111), (200), and (220) of γ-phase of FCC structure by an X-ray diffraction measurement subjected to a test specimen having a plane at a position 1.5 mm from the surface of the nickel-containing steel plate facing in the plate thickness direction constituting an observation surface of the test specimen is from 3.0 to 20.0% by volume, wherein when, on a cross section vertical to a rolling direction and the thickness direction of the nickel-containing steel plate, at a position 1.5 mm from the surface of the nickel-containing steel plate facing in the plate thickness direction, retained austenite phase at prior austenite grain boundaries is observed by electron beam backscatter diffraction in an observation of 20 or more visual fields, each having a size of 150 μm square, a maximum distance between centers of adjacent grains of retained austenite on prior austenite grain boundaries at the position 1.5 mm from the surface of the nickel-containing steel plate in the thickness direction, is 12.5 μm or less, and wherein when, on a cross section vertical to the rolling direction and the thickness direction of the nickel-containing steel plate, at a position 1.5 mm from the surface of the nickel-containing steel plate facing in the plate thickness direction, grains of retained austenite are observed by electron beam backscatter diffraction in an observation of 20 or more visual fields, each having a size of 150 μm square, a mean value of a circle equivalent diameter of grains of retained austenite at a position corresponding to ¼ of a plate thickness from the surface of the nickel-containing steel plate in the thickness direction, is 2.5 μm or less.

2. The nickel-containing steel plate according to claim 1, wherein a content of Ni is from 8.00 to 9.50% by mass.

3. The nickel-containing steel plate according to claim 1, having a yielding strength of from 590 to 800 MPa as measured in accordance with JIS Z 2241 (2011), a tensile strength of from 690 to 830 MPa as measured in accordance with JIS Z 2241 (2011), and a Charpy impact absorption energy at −196° C. of 150 J or more as measured in accordance with JIS Z 2224 (2005).

4. The nickel-containing steel plate according to claim 2, having a yielding strength of from 590 to 800 MPa as measured in accordance with JIS Z 2241 (2011), a tensile strength of from 690 to 830 MPa as measured in accordance with JIS Z 2241 (2011), and a Charpy impact absorption energy at −196° C. of 150 J or more as measured in accordance with JIS Z 2224 (2005).

5. The nickel-containing steel plate according to claim 1, having a plate thickness of from 6 to 50 mm.

6. The nickel-containing steel plate according to claim 2, having a plate thickness of from 6 to 50 mm.

7. The nickel-containing steel plate according to claim 3, having a plate thickness of from 6 to 50 mm.

8. The nickel-containing steel plate according to claim 4, having a plate thickness of from 6 to 50 mm.

9. A tank, comprising the nickel-containing steel plate according to claim 1.

10. A tank, comprising the nickel-containing steel plate according to claim 2.

11. A tank, comprising the nickel-containing steel plate according to claim 3.

12. A tank, comprising the nickel-containing steel plate according to claim 4.

13. A tank, comprising the nickel-containing steel plate according to claim 5.

14. A tank, comprising the nickel-containing steel plate according to claim 6.

15. A tank, comprising the nickel-containing steel plate according to claim 7.

16. A tank, comprising the nickel-containing steel plate according to claim 8.

* * * * *